US010759213B2

(12) United States Patent
Whiteman

(10) Patent No.: US 10,759,213 B2
(45) Date of Patent: Sep. 1, 2020

(54) METHODS OF MANUFACTURING SECURITY DEVICES

(71) Applicant: DE LA RUE INTERNATIONAL LIMITED, Basingstoke, Hampshire (GB)

(72) Inventor: Robert Whiteman, Reading (GB)

(73) Assignee: DE LA RUE INTERNATIONAL LIMITED, Basingstoke, Hampshire (GB)

( * ) Notice: Subject to any disclaimer, the term of this patent is extended or adjusted under 35 U.S.C. 154(b) by 0 days.

(21) Appl. No.: 16/080,116

(22) PCT Filed: Feb. 24, 2017

(86) PCT No.: PCT/GB2017/050500
§ 371 (c)(1),
(2) Date: Aug. 27, 2018

(87) PCT Pub. No.: WO2017/144911
PCT Pub. Date: Aug. 31, 2017

(65) Prior Publication Data

US 2019/0061409 A1 Feb. 28, 2019

(30) Foreign Application Priority Data

Feb. 26, 2016 (GB) ..... 1603341.7

(51) Int. Cl.
*B42D 25/378* (2014.01)
*B42D 25/30* (2014.01)
(Continued)

(52) U.S. Cl.
CPC ..... *B42D 25/378* (2014.10); *B41M 3/14* (2013.01); *B42D 25/29* (2014.10); *B42D 25/30* (2014.10); *B42D 25/351* (2014.10); *B42D 25/40* (2014.10)

(58) Field of Classification Search
CPC .... B42D 25/378; B42D 25/40; B42D 25/351; B42D 25/29; B42D 25/30; B41M 3/14
(Continued)

(56) References Cited

U.S. PATENT DOCUMENTS

2009/0045618 A1 2/2009 Williams et al.
2010/0164219 A1* 7/2010 Jeacock ..... B42D 25/369 283/94

FOREIGN PATENT DOCUMENTS

EP 0388090 A1 9/1990
EP 1389537 A1 2/2004
WO 2014/201559 A1 12/2014

OTHER PUBLICATIONS

Aug. 26, 2016 Combined Search and Examination Report issued in British Patent Application No. 1603341.7.
(Continued)

*Primary Examiner* — Justin V Lewis
(74) *Attorney, Agent, or Firm* — Oliff PLC

(57) ABSTRACT

A security device manufacturing method includes: providing a substrate having a viewing region; providing an obscuring layer in the region; providing a first image; applying a mask to the first image and swapping colour components of first and second sub-images of the first image forming: a mask pattern, and a background pattern representing the unswapped colour components on their assigned side; and printing the mask and background patterns on corresponding layer sides. The layer reduces colours visibility on one side when the other side of the layer is viewed in reflection, and allows light through the region when the security device is viewed in transmitted light. When either side of the region is viewed in reflected light, the patterns on that side are dominantly visible and may be distinguished. When the region is viewed in transmitted light from either side, the
(Continued)

region is transparent and the colour-composite image is visible.

20 Claims, 5 Drawing Sheets

(51) Int. Cl.
*B41M 3/14* (2006.01)
*B42D 25/40* (2014.01)
*B42D 25/351* (2014.01)
*B42D 25/29* (2014.01)

(58) Field of Classification Search
USPC ..... 283/67, 70, 72, 74, 75, 77, 98, 901
See application file for complete search history.

(56) References Cited

OTHER PUBLICATIONS

May 11, 2017 Search Report issued in International Patent Application No. PCT/GB2017/050500.
May 11, 2017 Written Opinion issued in International Patent Application No. PCT/GB2017/050500.
Apr. 16, 2018 International Preliminary Report on Patentability issued in International Patent Application No. PCT/GB2017/050500.

* cited by examiner

METHODS OF MANUFACTURING SECURITY DEVICES

FIELD OF THE INVENTION

This invention relates to methods of manufacturing security devices and to the corresponding products. Security devices are typically used on security documents such as banknotes, cheques, passports, identity cards, certificates of authenticity, fiscal stamps and other secure documents, in order to confirm their authenticity.

BACKGROUND TO THE INVENTION

A variety of security devices have been proposed in the past to prevent security documents from being counterfeited or fraudulently produced. A particularly useful security device is one which is readily verifiable by a user but which is difficult to produce. An example of such a security device is a "see-through" feature in which complementary images are provided on each side of a document precisely registered relative to one another such that when the document is held up to the light, the image on the back will fit exactly into spaces within the image on the front. For example, each image could comprise a series of coloured segments, segments on one side of the sheet fitting within the spaces between the segments on the other. Printing of these images is normally carried out with specialised lithographic presses which allow simultaneous front and back printing during one printing run.

See-through features have four modes of visual inspection—the image on the first side of the document viewed in reflected light, the image on the other side of the document viewed in reflected light, the composite image viewed by transmitted light as viewed from the first side and with the image on that side predominating, and finally the composite image as viewed on the other side of the sheet with the image on that side predominating. On transmissive viewing of see-through features the image on the opposite side of the document is seen to be in register in a genuine document.

Some known security devices comprise a substrate having a viewing region which is provided on one side with first indicia and on the other side with second indicia overlying the first indicia. The substrate may carry an obscuring material aligned with the second indicia so as to prevent the second indicia from being viewed from the one side of the substrate under reflected radiation.

Other known security features include patterns aligned on the front and back surfaces of a document. The document may be sufficiently transparent to allow see-through of the partial image on the back of the document to be superimposed on the partial image on the front of the document to form a complete image if the patterns are properly aligned.

Security devices which exploit subtractive colour mixing are also known. When such a device is viewed in reflection on either side, the contrast between the two colours enables the two patterns on that side to be distinguished. However, when the device is viewed in transmission, overlapping, different colours subtract respective wavelengths or wavelength bands from the incident light such that the resultant light transmitted through both sets of overlapping patterns has substantially the same colour and thus it is no longer possible to distinguish between the individual patterns.

Although security devices in the prior art perform satisfactorily, they have a number of disadvantages. In particular, the patterns of the conventional see-through features must be precisely registered relative to one another for images to be recognisable. Complete images are not recognisable if the patterns provided on either side of the device are misaligned.

The present invention is intended to avoid the drawbacks of the security features in the prior art and to provide improved features which exhibit novel surprising effects to prevent counterfeiting.

SUMMARY OF THE INVENTION

In accordance with one aspect of the present invention, there is provided a method of manufacturing a security device, the method comprising:

providing a substrate having a viewing region;

providing an obscuring layer in the viewing region;

providing a first image being a colour-composite image formed of first and second sub-images respectively with first and second sets of colour components of respective colours, each of the first and second sub-images having an assigned side of the obscuring layer;

providing a mask representative of a second image, the mask being indicative of locations of colour components to be swapped to the side opposite their assigned side of the obscuring layer;

applying the mask to the colour-composite image by swapping colour components of the first and second sub-images at each location indicated by the mask to the side opposite their assigned side, to form:

- a mask pattern representing the swapped colour components on the swapped side, and
- a background pattern representing the unswapped colour components on their assigned side;

printing the mask and background patterns on their corresponding side of the obscuring layer;

wherein the obscuring layer between the printed patterns reduces the visibility of colours on the one side when the other side of the obscuring layer is viewed in reflection, the obscuring layer allowing light to pass through the viewing region when the security device is viewed in transmitted light, whereby

- when either side of the viewing region is viewed in reflected light, the patterns on that side are dominantly visible and may be distinguished at least by their colours; and
- when the viewing region is viewed in transmitted light from either side of the viewing region, the viewing region is sufficiently transparent that colour mixing between the overlapped different colours of the overlapped patterns results in the colour-composite image being visible.

We have developed a new type of see-through feature wherein sub-images of respective colours forming a first, colour-composite (typically a "full colour") image to be viewed in transmission are "split" across the two sides of the obscuring layer. Each set of colour components representing a sub-image are initially assigned to a side of the obscuring layer. The colour-composite image is then processed to form a second image to be viewed in reflection. Specifically, a mask pattern and a background pattern are obtained by applying a mask to the colour-composite image and swapping colour components to the side of the obscuring layer opposite their initially assigned side. The mask is representative of the second image and indicates the locations of colour components of the colour-composite image to be swapped to the opposite side of the obscuring layer. The mask patterns outlining the second image are dominantly visible in reflection, while the first, colour-composite image is revealed in transmission. This optical effect is unexpected and therefore striking and memorable to the viewer. An advantage of this security device is that it is easy to inspect but difficult to fabricate.

Each location in an image represents an image signal associated with a particular position in the image. The images may be pixelated although this is not essential. Each location in a pixelated image may be referred to as a "pixel" or "dot". A colour-composite image is a multi-dimensional array wherein each location value is a set of colour space coordinates in a colour coordinate form. It will be appreciated that a "set of colour components" may include only one colour component if required. A colour-composite image may be said to be formed of two or more sub-images, each sub-image with none, one or more "colour components" of a respective colour. The sub-images may be arranged in colour layers, depending on the chosen printing technique and colour model.

For example, the "CMYK" colour model is a subtractive colour model used in standard printing techniques wherein cyan, magenta, yellow and black ("key", or "K", which allows for no light transmission) each form a sub-image of a single colour. The sub-image is thus formed of colour components of the same colour and may be thought of as a colour component layer. The terms "sub-image" and "colour component layer" may be used interchangeably although it will be appreciated that, typically, the sub-images are not ordered or homogeneous. In fact, the presence or absence of colour components at various locations in the sub-images determine the colours of the full-composite image. Each location of the full-colour composite image has colour components, from none, one or more sub-images.

The colour-composite (multi-component) image is then "split" into sub-images of corresponding colours, each sub-image having colour components and each sub-image assigned to a side of the obscuring layer in the viewing region. When printed on one side or on either side of a transparent substrate, the combination of sub-images provides a colour-composite image due to colour mixing. The colours visible either side of the viewing regions at a particular location are different when viewed in transmission than when viewed in reflection. This is true for both the masked and the background areas (those areas which have not been swapped by the mask, which may be referred to as non-masked areas) since, in transmission, colour mixing results in the full colour composite image being visible. Preferably, there is no location in the colour-composite image having the same colours split or assigned either side of the obscuring layer, so that the colour mixing effect occurs at all locations of the composite image. Accordingly, colour mixing is said to occur throughout the masked as well as background (non-masked) areas of the colour-composite image. Depending on the colour model chosen, colour mixing could be additive rather than subtractive.

It will be appreciated that the order in which the colour components are printed on the substrate (i.e. before or after swapping) does not matter when they are viewed in transmission, as the resultant colour at each location due to colour mixing is due to the combination of all colour components in the line of sight. Accordingly, the resultant colour in transmission will be the same irrespective of the location of the individual colour components in the printed layers in a direction corresponding to the transmission direction. On the other hand, the location of the components either side of the obscuring layer is important, as it determines the colour to be viewed in reflection against the obscuring layer.

A colour-composite (typically full-colour) image may be contrasted to a "binary image". A binary image is a two-dimensional array which has a single colour space coordinate and therefore only contains location information. A binary image contains no information of its specific colour. The most basic type of a "binary image" is a black and white image, represented by a two-dimensional array having black pixels have the value of "1" and white pixels have the value "0".

A "mask" provides location information for those components of each sub-image which are to be swapped to the other side of the obscuring layer. A mask is used to screen the composite image to obtain mask patterns consisting of colour components at the locations indicated by the mask. For example, the mask pattern may be pixelated (i.e. a "dot screen"), comprising pixel components "inside" the mask (i.e. the locations indicated by the mask), although it will be appreciated that the components may take any suitable shape and size since it is not necessary for the image to be pixelated. In a binary image, a "mask pattern" is distinguished from a background pattern by its component values ("1" or "0") defining its location. In a colour-composite image, a mask pattern is distinguished from a background pattern by its component values in colour space. The mask patterns are to be printed on the opposite, swapped side, whilst the background patterns are to be printed on the originally assigned side.

According to the present invention the specific mask is chosen to outline the desired second image to be viewed in reflection, the second image consisting of coloured mask and background patterns formed from the swapped colour components of the first, colour-composite image. In other words the mask chosen to process the first, colour-composite image is representative of the desired second image.

The particular colour-composite image colours and splitting of the colour components either side of the obscuring layer are chosen such that, when components are swapped according to the mask, the background patterns viewed in reflection are generally ordered in order for the mask pattern on the same side to "stand out" against the background pattern and be distinguished in reflection. Preferably, the coloured mask patterns and background patterns define solid areas of the respective colours in order to be distinguished well when viewed in reflection.

The background patterns are formed by the "unswapped" colour components, which are those components "outside" the mask (i.e. at locations other than those indicated by the mask). Accordingly, the colour of the background pattern on one side viewed in reflection is the colour formed of the colour components of the full-colour image assigned to that particular side. In contrast, the colour of the mask pattern on that side is the colour formed of the colour components of the colour-composite image assigned to the other side, before swapping.

The printed mask and background patterns respectively superimpose and are preferably in register with each other. In other words, when printed, the mask and background patterns are located at mirror (corresponding), locations either side of the substrate so that the colour-composite image may be revealed in transmission.

The patterns are printed either side of the obscuring layer, on the same, or either side of the transparent viewing region of the substrate. The patterns may be printed using lithography, UV cured lithography, intaglio, letterpress, flexographic printing, gravure printing, digital printing such as inkjet, or screen-printing. The patterns printed on the front and back of the substrate may be printed simultaneously for example in the case of lithography. The patterns can be provided using conventional inks such as coloured inks, white inks, black inks, metallic inks, optically variable inks (such as those incorporating thin film optical interference filters or liquid crystal pigment) and the like. Thermochromic inks, photochromic inks, magnetic inks, infrared absorbing inks and fluorescing and phosphorescing inks may also be employed.

On one hand, when a first side of the obscuring layer is viewed in reflection, the obscuring layer reduces visibility of the patterns on the other side of the obscuring layer. Accordingly, the patterns on the first side of the obscuring layer are dominantly visible, and "stand out" to the viewer. On the other hand, when viewed in transmission, the obscuring layer is partially transparent, allowing light to pass through the viewing region and thus allowing the colour-composite image to be visible.

In some embodiments a relatively high opacity layer may be printed onto the viewing region. The high opacity layer may be, for example, a "K" sub-image of the colour-composite image to which the mask may or may not apply. In addition to, or instead the relatively high opacity layer, the obscuring layer may be a vapour deposited metallic layer in the form of a masking coat or a screen. The obscuring layer may be provided on one or both sides of the substrate, between the printed coloured patterns. The obscuring layer may be itself patterned to outline an image which may comprise indicia. Accordingly, the appropriate patterning of the obscuring layer may further provide a means of integrating "hidden" images or transmission designs.

For example, the obscuring layer may comprise a screen with an array of closely spaced fine lines or dots, wherein, in localised regions the absorbing coverage will be complete, i.e. substantially 100%, forming a permanent image which is revealed in transmitted light. In an alternative embodiment, the absorbing screen may comprise a permanent image formed in localised areas by the complete removal of the metal. The screen may be provided instead or in addition to the high opacity layer.

The obscuring layer is necessary to reflect the colours of the colour components printed on either side of the obscuring layer, so that the colours of the mask and background patterns dominate when viewed in reflection. When viewed in reflected light, therefore, colour mixing with components from the other side of the obscuring layer is prevented or minimised. On the other hand, when viewed in transmitted light, the obscuring layer does allow light to pass through (i.e. is partially obscuring), so that colour mixing occurs and the full-colour composite image is revealed instead of the mask and background patterns.

The substrate in the viewing region may be the same substrate as that of the secure document it is protecting, for example the security feature of the current invention may be applied by printing the patterns on either side of a traditional banknote paper. In this case the substrate will also form the obscuring layer. The substrate may be more transparent in the viewing region than elsewhere. In the case of a solely paper substrate the area of greater transparency will be formed typically during the manufacture of the substrate.

Alternatively the substrate comprises a semi-transparent viewing region comprising a polymeric material. Techniques are known in the art for forming transparent regions in both paper and polymeric substrates. For example, polymer banknotes may be formed from a transparent substrate comprising an opacifying coating on both sides of the substrate. The opacifying coating is omitted in localised regions on both sides of the substrate to form a transparent region. Methods are also known for making transparent polymeric regions in paper substrates.

Polymer document substrates suitable for the current invention have an opacifying coating applied on one or both surfaces of the polymer substrate. Each opacifying layer comprises a translucent, semi-opaque material which is preferably polymeric and non-fibrous, e.g. white ink. The opacifying layers are each preferably substantially the same colour as one another (and are spatially uniform in colour), most preferably white or another light colour such as off-white or grey so that a later-applied graphics layer will contrast well against it. In preferred examples, the opacifying layers each have a brightness L* in CIE L*a*b* colour space of at least 70, preferably at least 80 and more preferably at least 90. For example, each opacifying layer may comprise a resin such as a polyurethane based resin, polyester based resin or an epoxy based resin and an opacifying pigment such as titanium dioxide ($TiO_2$), silica, zinc oxide, tin oxide, clays or calcium carbonate.

Two or more opacifying layers may be applied to each surface of the polymer substrate in order to achieve the necessary opacity. The optical density of each layer by itself may typically be around 0.1 to 0.5. Preferably, 3 or more layers are applied to each surface, overlapping one another.

In a preferred embodiment, at least one of the opacifying layers (preferably one on each surface of the polymer substrate is made electrically conductive, e.g. by the addition of a conductive pigment thereto. This reduces the effect of static charges which may otherwise build up on the security document during handling.

The opacifying layers are preferably applied to the polymer substrate using a printing process such as gravure printing, although in other case the opacifying layers could be coated onto the substrate, or applied by offset, flexographic, lithographic or any other convenient method. Depending on the design of the security document, the opacifying layers may be omitted across gaps on one or both surfaces of the polymer substrate to form window regions (which may be full windows or half windows, or a mixture of both). This can be achieved through appropriate patterning of the opacifying layers during the application process.

In the present invention the obscuring layer of the viewing region may be formed by a thinner region of the opacifying coating compared to the rest of the polymer document substrate. For example in the viewing region a single layer of the opacifying coating may be applied on one side of the substrate whereas in the rest of the document three layers of the opacifying coating may be applied to each side of the substrate.

In accordance with a further aspect of the present invention there is provided a security device comprising:

a substrate having a viewing region;

an obscuring layer in the viewing region; and, mask and background patterns printed in the viewing region according to a mask applied to a first image being a colour-composite image, the colour-composite image formed of first and second sub-images respectively with first and second sets of colour components of respective colours, each of the first and second sub-images having an assigned side of the obscuring layer;

wherein the mask is representative of a second image, the mask being indicative of locations of colour components to be swapped to the side opposite their assigned side of the obscuring layer;

wherein the mask is applied by swapping colour components of the first and second sub-images at each location indicated by the mask to the side opposite their assigned side, to form:

a mask pattern representing the swapped colour components on the swapped side, the mask pattern being printed on the swapped side, and a background pattern representing the unswapped colour components on their assigned side, the background pattern being printed on the assigned side;

wherein the obscuring layer between the printed patterns reduces the visibility of colours on the one side when the other side of the obscuring layer is viewed in reflection, the obscuring layer allowing light to pass through the viewing region when the security device is viewed in transmitted light, whereby when either side of the viewing region is viewed in reflected light, the patterns on that side are dominantly visible and may be distinguished at least by their colours; and when the viewing region is viewed in transmitted light from either side of the viewing region, the viewing region is sufficiently transparent that colour mixing between the overlapped different colours of the overlapped patterns results in the colour-composite image being visible.

The security devices discussed herein find particularly beneficial application when used in association with articles of value. In some examples where the article of value comprises a transparent material then the security devices may be formed integrally with the article of value, for example by using a region of the transparent material as the substrate of the security device. Thus the security device is applied directly to the article of value in this case. The term "transparent" here is used in the sense of being sufficiently transparent for the optical effects of the security device to be observed and therefore includes materials that exhibit some degree of diffusivity, translucency or selective spectral filtering. As one example, part of the transparent wall of a perfume bottle could be used as the substrate of the security device, with each of the printed patterns and obscuring layer being provided on an external surface of the substrate.

In other examples the security device may be provided directly upon a transparent label for adhering to a transmissive region of the article of value or the packaging of such an article. The transparent substrate of the label may be used as the substrate of the security device or the security device may be adhered to the label. Such labels are advantageous since they are discrete items which can be handled readily by automated manufacturing processes. In other examples the security devices may be formed integrally with the packaging for an article of value, such as wrapping or tear strips. Typically such wrapping is provided as a clear polymer film which encloses the article. Likewise the security devices may be adhered to such packaging, including using labels. The security devices of the packaging may be inspected in reflection and transmission following removal of the packaging. Alternatively they may be inspected in situ when the packaging is applied to the article, if used in association with a transparent region of the article, or if provided in a location of the packaging which may be viewed from opposing sides, such as if located in a projecting tab, a flap or a tag. A projecting label or a tag may likewise be inspected particularly if the article of value to which it is attached does not contain a transparent region. As will be understood, in each case where a security device is adhered to a particular object it is advantageous to ensure that the security device is irreversibly adhered to the object such that it cannot be removed without destroying the security device.

The articles of value may be provided in numerous different forms including bottles or containers for high value liquids (such as perfumes, wines and spirits, printing inks), clothing and footwear, consumer electronics (such as tablets and smartphones), cigarettes and tobacco products, security documents and so on. The packaging for the articles may also take numerous different forms including containers, boxes, pouches and envelopes, together with any exterior wrapping (including shrink wrapping) or other protective layers.

Examples of security documents with which the present invention can be used include banknotes, passports, identity cards, fiscal stamps, cheques, postal stamps, certificates of authenticity, articles used for brand protection, bonds, payment vouchers, and the like.

BRIEF DESCRIPTION OF THE DRAWINGS

Some examples of security devices located on or in security documents according to the invention will now be described with reference to the accompanying drawings, in which.

DESCRIPTION OF EMBODIMENTS

We now describe a number of different examples of security devices applicable to security documents. Common to the production of each of these example security devices is a general method of forming the security devices and this is now firstly described in relation to FIG. 1.

Figure 1:
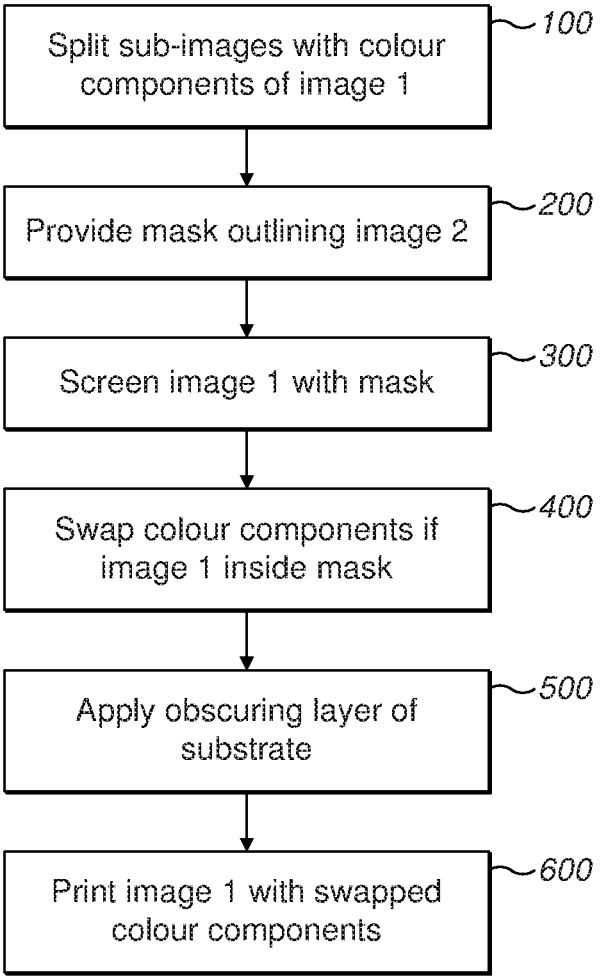
FIG. 1 is a flow diagram of a general method applicable to each example.

FIG. 1 is a flow diagram of the key stages in the process of forming such a security device. Initially, at step 100, a composite-colour image ("Image 1") is chosen as the image to be viewed in transmission. When printed, the full-colour image may be represented, in this example, by the "CMYK" colour model. Accordingly, the colour-composite-image is formed of four sub-images, each having corresponding sets of colour components: cyan (C), magenta (M), yellow (Y), and black (K). Image 1 may be the image shown in FIG. 5*c*, for example.

Figure 2A:
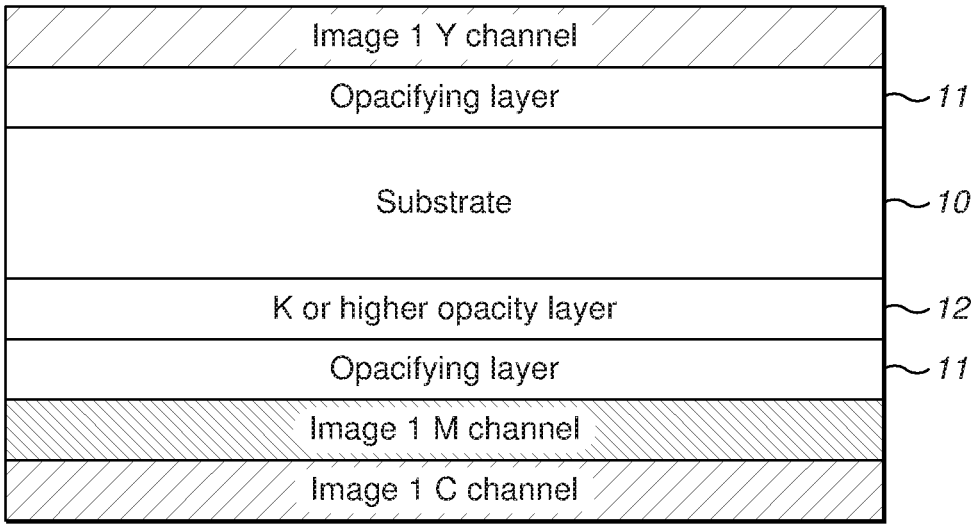
FIGS. 2*a* and 2*b* are cross-sections through a first example of a security device.

The colour components of Image 1 are "split", so that they are each associated with either side of the obscuring layer to be printed on. By way of example, the Y component is to be printed on the front of the substrate comprising the obscuring layer, while the C, M, and K components are to be printed on the other side of a substrate 10, as shown for example in FIG. 2*a*. Although FIG. 2*a* shows only a small section of the device, where each of the colour components or "channels" is a homogeneous layer with no gaps between the colour components in either layer, layers are not homogeneous throughout the entire image. It will be appreciated that the number of the sub-images assigned to either side of the substrate may vary. For example, in a colour model with 4 colour components, the split numbers of sub-images either side may be 0/4, 1/3, 2/2, 3/1 or 4/0.

Figure 3:
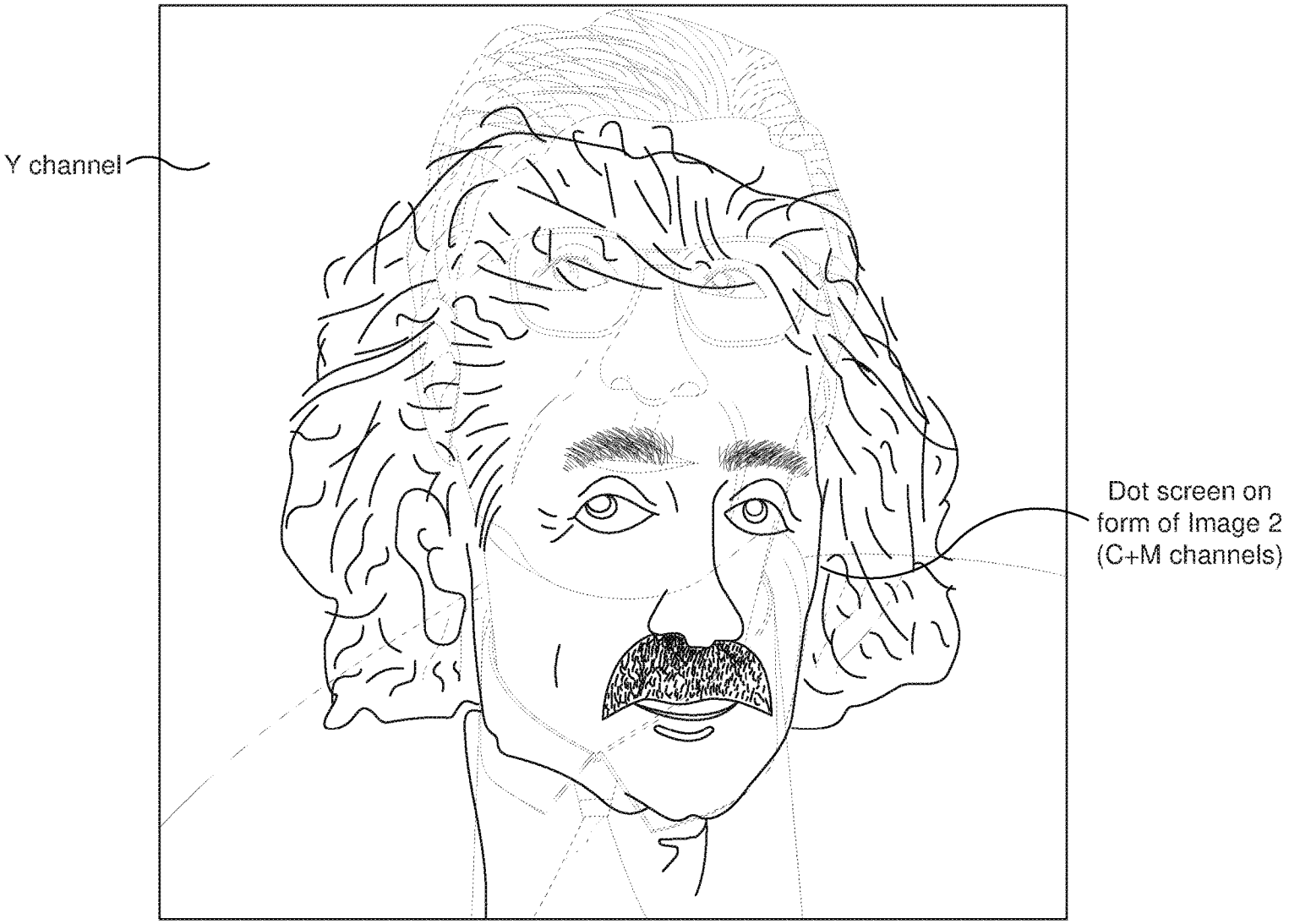
FIG. 3 is an illustration of the security device of the first example when viewed in reflection.

Referring back to FIG. 1, the next step 200 is to provide an image to be viewed in reflection ("Image 2") and a mask outlining this image. FIG. 3 illustrates an Einstein profile representing an example "Image 2" when viewed in reflection. Next, Image 1 is processed to form Image 2 as is described with reference to steps 300 and 400 below. The mask pattern outlining Image 2 may represent continuous areas or blocks, or be discontinuous.

Figure 2B:
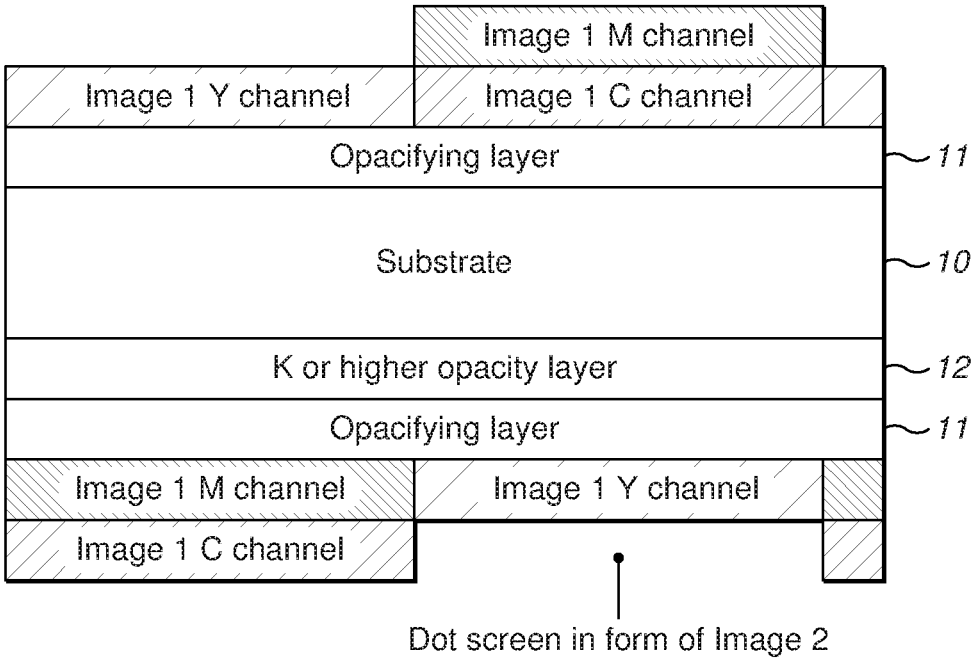

At step 300, Image 1 is screened with the mask and at step 400, colour components either side are swapped inside the mask to form mask patterns, as schematically shown in the section of FIG. 2*b*. In this case, the C and M colour components of Image 1 are "moved" to the front of the substrate, while the Y colour component is "moved" to the back of the substrate, inside the mask. The order of the C and M colour components either side of the obscuring layer at each location does not matter.

FIG. 3 shows an example of the device viewed in reflection from the front side of the viewing region, with the mask pattern (Einstein's profile) made up of the cyan and magenta colour components being perceived against a yellow background. The yellow background is dominant in reflection, being backed by an obscuring layer, included at step 500, as will be described below. Similarly, when the device is viewed in reflection from the back side of the viewing region, a yellow mask pattern (Einstein's profile) made up of the swapped yellow components will be viewed against a background pattern made up of the cyan and magenta colour components. It will be appreciated that, in practice, a faint outline of Image 1 (a residual image) may additionally be perceived by the user, as illustrated in FIG. 3.

At step 500, an obscuring layer, also referred to as an opacifying layer 11,12 is provided to the substrate to be located between printed layers as shown in FIGS. 2*a* and 2*b*. In this case, the substrate is a transparent substrate 10 comprising an opacifying coating 11 on both sides of the substrate. It will be appreciated that the obscuring layer 12 may be provided one or both sides of the substrate anywhere between the printed layers. In some embodiments, the obscuring layer is a multi-layer (i.e. comprising two or more obscuring layers) and may comprise a "K" or "thick white" layer representing a "K" sub-image of the full-colour image. The mask may or may not be applied to the "K" sub-image. In particular embodiments, a "K" layer is provided between two opacifying layers located either side of the substrate, as shown in FIG. 2*b*. The "K" layer is not necessarily applied to the whole viewing region, and may be non-uniform.

The obscuring layer is provided so that, in reflection, the colours on the side being viewed are dominant, and the effect of the colour on the opposite side of the substrate is negligible. In the case shown with reference to FIGS. 2*b* and 3, a yellow mask pattern is the dominant colour when the back side of the device is viewed in reflection, whilst a mask pattern of the colours resulting from a combination of cyan and magenta is dominant when the front side of the device is viewed in reflection. Similarly, a yellow background is dominant in reflection on the front side, whilst a cyan and magenta background is dominant in reflection on the back side. In transmission, the obscuring layer is sufficiently transparent to allow the result of the colour mixing of the colours of the component layers for Image 1 to be observed as a full colour composite, as shown in FIG. 5*c*, for example.

At step 600, the patterns obtained following the processing of Image 1 at steps 300 are printed either side of the obscuring layer, on the front and back sides of the substrate in this example. The patterns either side of the viewing region may be printed simultaneously on the front and rear side of the viewing region using a conventional technique such as lithographic printing. Alternatively the front and rear side may be printed in-line using a process such as gravure. Preferably, the printing is performed after the viewing region and obscuring layer have been provided to the substrate.

The use of an obscuring layer is known for conventional see-through features. A wide variety of materials could be used for the obscuring material but a good example for the present invention is the use of a "K" or "thick white" opacifying layer representing a "K" sub-image of the full-colour image which is not processed by the mask. Additionally or alternatively, the obscuring layer may comprise a vapour deposited metallic layer. For example the transparent substrate within the viewing region could be coated with a metallic material which is then partially demetallised to enable the feature to be viewed in transmitted light.

The obscuring may be in the form of a screen. For example, the metallised pattern could be an array of dots or lines with sufficient coverage to maintain the reflectivity but sufficiently transparent to enable colour mixing of the colour component layers to be viewable in transmitted light. Non-linear screens are also envisaged. For example the screen could comprise a circular or sinusoidal array of dots or lines. The screen can be regular or stochastic. Indeed, the term "screen" should be construed broadly to encompass many different shapes of screen elements.

Preferably, the overall transmission of the screen pattern (representing the percentage of light intensity transmitted through the screen) is in the range 20-80%, and more preferably in the range 40-70% and even more preferably in the range 50-70%. The width of the lines or the diameter of the dots forming the screen are preferably in the range 50-250 μm and the spaces between the dots or lines are also in the range 50-250 μm with values of each set chosen to achieve the desired screen coverage.

The metallised pattern could be an array of dots or lines with sufficient coverage to maintain the reflectivity of the layers printed either side of the screen, but sufficiently transparent to enable colour mixing of the colour component layers to be viewable in transmitted light. This is particularly appropriate with a polymeric substrate. Alternatively, the substrate could be coated with a very thin film of aluminium, metal oxide or other reflective layer such that again it exhibits both high reflectivity and sufficient transparency. As an alternative to a vapour deposited metallic layer the obscuring layer could be formed by a printed metallic ink.

Alternatively the obscuring layer can comprise a coat, such as Coates 3188XSN or Coates Heliovyl White S90 353 for example. A typical coat weight is suggested to be in the region of 1-3GSM. These coats are already commonly used in banknote security threads to conceal information in reflected light.

In the case of a polymer document substrate such as a banknote the obscuring layer is preferably formed from the opacifying coating applied to the polymer substrate and will comprise a resin such as a polyurethane based resin, polyester based resin or an epoxy based resin and an opacifying pigment such as titanium dioxide (TiO2), silica, zinc oxide, tin oxide, clays or calcium carbonate.

Two or more opacifying layers may be applied to each surface of the polymer substrate in order to achieve the necessary opacity. The optical density of each layer by itself may typically be around 0.1 to 0.5. Preferably, 3 or more layers are applied to each surface, overlapping one another.

In a preferred embodiment, at least one of the opacifying layers (preferably one on each surface of the polymer substrate is made electrically conductive, e.g. by the addition of a conductive pigment thereto. This reduces the effect of static charges which may otherwise build up on the security document during handling.

The opacifying layers are preferably applied to the polymer substrate using a printing process such as gravure printing, although in other case the opacifying layers could be coated onto the substrate, or applied by offset, flexographic, lithographic or any other convenient method. Depending on the design of the security document, the opacifying layers may be omitted across gaps on one or both surfaces of the polymer substrate to form window regions (which may be full windows or half windows, or a mixture of both). This can be achieved through appropriate patterning of the opacifying layers during the application process.

In the present invention the obscuring layer of the viewing region may be formed by a thinner region of the opacifying coating compared to the rest of the polymer document substrate. For example in the viewing region a single layer of the opacifying coating may be applied on one side of the substrate whereas in the rest of the document three layers of the opacifying coating may be applied to each side of the substrate.

The security document shown in the example of FIG. 4 comprises a substrate 10 which may be paper or polymer, in this case paper. The substrate 10 defines front and rear sides and has a substantially transparent viewing region 2. The substantially transparent viewing region 2 may have been formed using any of conventional methods.

Printed on the front side of the viewing region 2 (FIG. 4*a*) is a first mask pattern 3 in colour A and a first background pattern 4 in colour B. In this example, the mask component 4 is in the shape of a star. It will be appreciated that the colours of the patterns printed on the front side may have one or multiple colour channels obtained by standard methods such as lithographic, gravure, screen or digital printing. In other words, colour A or colour B printed on the front side may represent one colour component if the full-colour image has a single colour component assigned to the front side, or may represent two or more colour components if the full-colour image has two or more colour components assigned to the front side. The split of the colour components of the full-colour image and the colours of the inks are preferably chosen to provide relatively high contrast between the regions defined by colours A and B when viewed in reflection.

Printed on the rear side of the viewing region 2 is a second mask component 5 in colour B and a second background image component 6 in colour A. The second dot pattern 5 is the same as the first dot pattern 3 apart from the fact that the colours are now reversed such that colour A now forms the star shape 5 and colour B forms the background region 6.

The second mask component 5 has the same shape as the first mask component 3 and is in substantially perfect register, being directly superimposed on the first mask component 3.

Figure 4A:
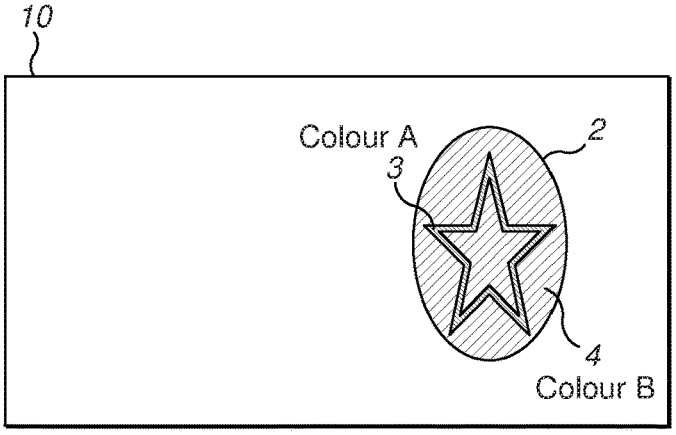
FIGS. 4*a*-4*c* are plan views of a second example of a security device when viewed in reflection from opposite sides and in transmission respectively.
Figure 4B:
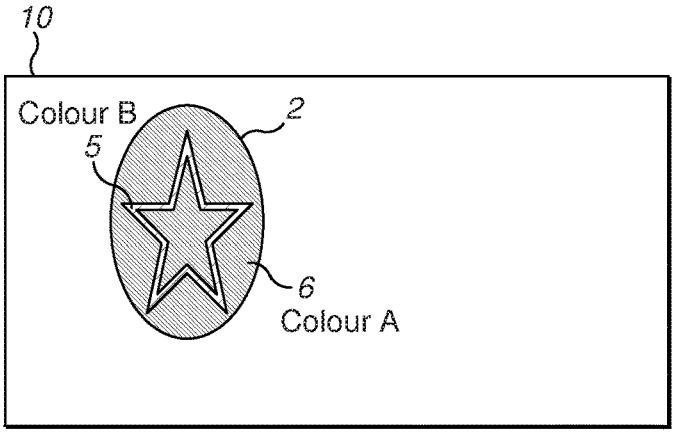
Figure 4C:
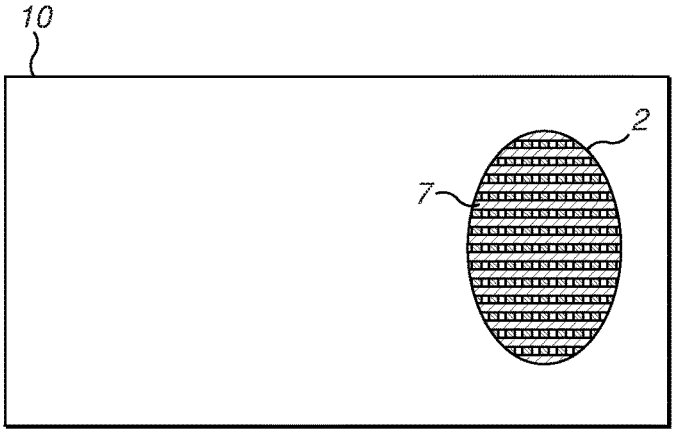

When viewing the device in reflection from the front of the substrate the first mask pattern (star in Colour A) is observed against the first background in Colour B (FIG. 4*a*). Likewise when viewing the device in reflection from the rear of the substrate the second mask pattern 5 (star) is observed against a background in reversed colours from the front side (FIG. 4*b*). When viewing the device in transmission, from either side of the device, the coloured printed inks, a colour composite image 7 (having sets of colour components A and B split between both sides of the obscuring layer) is observed as a result of subtractive colour mixing. The distribution of the colour components within each colour component layer (with absence of colour components in a layer) is such that colour mixing between the overlapped patterns forms a pattern from a combination of Colour A and Colour B components. In this manner, the mask patterns (star shapes) disappear when viewed in transmission and are replaced with the full colour-composite image 7, as shown in FIG. 4*c*.

Figure 5A:
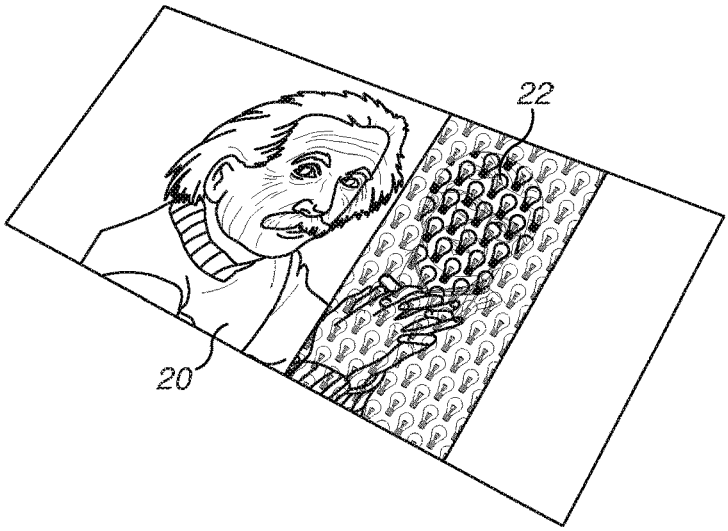
FIGS. 5*a* to 5*c* illustrate further examples of a security device according to the invention.
Figure 5B:
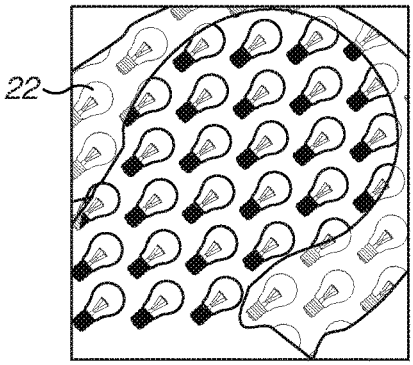
Figure 5C:
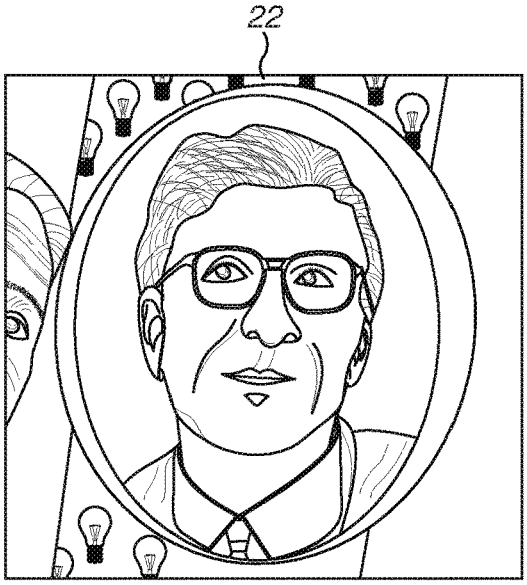

FIG. 5*a* shows another example of a banknote 20 provided with a security device having a viewing region 22, viewed in reflected light. It may be seen that the banknote 20 comprises additional security devices as known in the art, some of them forming indicia. FIG. 5*b* is a close-up of the viewing region 22 viewed in reflection from the front side, with mask patterns representing lightbulbs. FIG. 5*c* shows the viewing region when viewed in transmission from either side of the device, showing the colour-composite image.

The invention claimed is:

1. A method of manufacturing a security device, the method comprising:

providing a substrate having a viewing region;

providing an obscuring layer in the viewing region;

providing a first image being a colour-composite image, the colour-composite image being formed of a first sub-image and a second sub-image, wherein:

the first sub-image and the second sub-image are respectively formed of a first set of colour components and a second set of colour components, the first sub-image and the second sub-image are each initially assigned to one of two sides of the obscuring layer, and each of the first and second sub-images is not homogeneous;

applying a mask representative of a second image to the first image;

swapping colour components of the first and second sub-images of the first image at each location indicated by the mask, such that:

the first set of colour components of the first sub-image is re-assigned from its initially assigned side of the obscuring layer to the other side at each location indicated by the mask, and the second set of colour components of the second sub-image is re-assigned from its initially assigned side of the obscuring layer to the other side at each location indicated by the mask, wherein the swapping of colour components results in, at each side of the obscuring layer, a mask pattern representing the swapped colour components, and a background pattern representing unswapped colour components;

printing the mask and background patterns on their corresponding side of the obscuring layer;

wherein the obscuring layer between the printed patterns reduces a visibility of colours on one side when the other side of the obscuring layer is viewed in reflection, the obscuring layer allowing light to pass through the viewing region when the security device is viewed in transmitted light, whereby:

when the viewing region is viewed in reflected light from either side of the obscuring layer, the patterns on the viewed side of the obscuring layer are dominantly visible compared to the patterns on the other side, and the patterns on the viewed side are distinguished from each other at least by their respective colours to make the second image visible; and when the viewing region is viewed in transmitted light from either side of the obscuring layer, the viewing region is sufficiently transparent that colour mixing between overlapped different colours of the patterns on both sides of the obscuring layer results in the first image, which is the colour-composite image, being visible.

2. The method according to claim 1, wherein the first sub-image is assigned to one side of the obscuring layer, the second sub-image is assigned to the other side of the obscuring layer, and applying the mask to the colour-composite image results in forming the mask and background patterns respectively for printing on each side of the obscuring layer.

3. The method according to claim 1, wherein the colour mixing between the overlapped different colours is additive or subtractive colour mixing.

4. The method according to claim 2, wherein the mask patterns printed on either side of the obscuring layer are superimposed on and in register with one another.

5. The method according to claim 1, wherein the mask pattern defines indicia.

6. The method according to claim 1, wherein the mask pattern defines continuous blocks of respective colours or discontinuous regions.

7. The method according to claim 1, wherein the background pattern is ordered or homogeneous.

8. The method according to claim 2, wherein the mask pattern and the background pattern printed on one of the sides of the obscuring layer define solid areas of respective colours.

9. The method according to claim 1, wherein, when the security device is viewed in transmission, the resultant colour-composite image is a full colour-composite image representing an indicium, or symbol, alphanumeric character.

10. The method according to claim 1, wherein the patterns are printed on the substrate by one of lithography, UV cured lithography, intaglio, letterpress, flexographic printing, gravure printing, digital printing or screen-printing.

11. The method according to claim 1, wherein the patterns are printed using one or more of coloured inks, white inks, black inks, metallic inks, optically variable inks, and fluorescent inks.

12. The method according to claim 1, wherein printing is performed after the viewing region and obscuring layer have been provided to the substrate.

13. The method according to claim 1, wherein the obscuring layer is semi-transparent.

14. The method according to claim 1, comprising providing at least one opacity layer printed onto the viewing region.

15. The method according to claim 14, wherein the opacity layer is a third sub-image of the colour-composite image positioned at areas of the substrate to which the mask does not apply, and the third sub-image comprises a set of "K" colour components.

16. The method according to claim 14, wherein the opacity layer is the first sub-image of the colour-composite image, and the first sub-image comprises a set of "K" colour components.

17. The method according to claim 1, wherein transparency of the substrate varies over the viewing region.

18. The method according to claim 1, wherein the substrate comprises a transparent polymer provided with at least one layer of an opacifying coating, the viewing region being defined by omitting the opacifying coating in a localised region.

19. A security device comprising:

a substrate having a viewing region;

an obscuring layer in the viewing region; and mask and background patterns printed in the viewing region according to a mask applied to a first image being a colour-composite image, the colour-composite image being formed of a first sub-image and a second sub-image, wherein the first sub-image and the second sub-image are respectively formed of a first set of colour components and a second set of colour components, the first sub-image and the second sub-image are each initially assigned to one of two sides of the obscuring layer, and each of the first and second sub-images is not homogeneous;

wherein the mask is representative of a second image and is applied to the first image;

wherein colour components of the first and second sub-images of the first image are swapped at each location indicated by the mask, such that:

the first set of colour components of the first sub-image is re-assigned from its initially assigned side of the obscuring layer to the other side at each location indicated by the mask, and the second set of colour components of the second sub-image is re-assigned from its initially assigned side of the obscuring layer to the other side at each location indicated by the mask, wherein each side of the obscuring layer includes:

a printed mask pattern representing the swapped colour components, and a printed background pattern representing unswapped colour components;

wherein the obscuring layer between the printed patterns reduces a visibility of colours on one side when the other side of the obscuring layer is viewed in reflection, the obscuring layer allowing light to pass through the viewing region when the security device is viewed in transmitted light, whereby:

when the viewing region is viewed in reflected light from either side of the obscuring layer, the patterns on the viewed side of the obscuring layer are dominantly visible compared to the patterns on the other side, and the patterns on the viewed side are distinguished from each other at least by their respective colours to make the second image visible; and when the viewing region is viewed in transmitted light from either side of the obscuring layer, the viewing region is sufficiently transparent that colour mixing between overlapped different colours of the patterns on both sides of the obscuring layer results in the first image, which is the colour-composite image being visible.

20. An article of value comprising the security device according to claim 19, wherein the article of value is a security document, the security document comprising: banknotes, passports, ID cards, fiscal stamps, cheques, postal stamps, certificates of authenticity, articles used for brand protection, bonds, or payment vouchers, or wherein the article of value comprises: a bottle for a liquid, a container for a liquid, clothing, footwear, a consumer electronic product, cigarettes, a tobacco product, or a software product.

* * * * *